United States Patent [19]

Malsheen et al.

[11] Patent Number: 4,979,216

[45] Date of Patent: Dec. 18, 1990

[54] TEXT TO SPEECH SYNTHESIS SYSTEM AND METHOD USING CONTEXT DEPENDENT VOWEL ALLOPHONES

[76] Inventors: Bathsheba J. Malsheen, 513 Clayton St., San Franciscca, Calif. 94117; Gabriel F. Groner, 230 Parkside Dr., Palo Alto, Calif. 94306; Linda D. Williams, 466 Northlake Dr., San Jose, Calif. 95117

[21] Appl. No.: 312,692

[22] Filed: Feb. 17, 1989

[51] Int. Cl.[5] ..... G10L 5/00

[52] U.S. Cl. ..... 381/52

[58] Field of Search ..... 381/51, 52

[56] References Cited

U.S. PATENT DOCUMENTS 4,685,135 8/1987 Lin et al. ..... 381/52

4,695,962 9/1987 Goudie ..... 381/51

*Primary Examiner*—Emanuel S. Kemeny

*Attorney, Agent, or Firm*—Flehr, Hohbach, Test, Albritton & Herbert

[57] ABSTRACT

A text-to-speech conversion system converts specified text strings into corresponding strings of consonant and vowel phonemes. A parameter generator converts the phonemes into formant parameters, and a formant synthesizer uses the formant parameters to generate a synthetic speech waveform. A library of vowel allophones are stored, each stored vowel allophone being represented by formant parameters for four formants. The vowel allophone library includes a context index for associating each said vowel allophone with one or more pairs of phonemes preceding and following the corresponding vowel phoneme in a phoneme string. When synthesizing speech, a vowel allophone generator uses the vowel allophone library to provide formant parameters representative of a specified vowel phoneme. The vowel allophone generator coacts with the context index to select the proper vowel allophone, as determined by the phonemes preceding and following the specified vowel phoneme. As a result, the synthesized pronunciation of vowel phonemes is improved by using vowel allophone formant parameters which correspond to the context of the vowel phonemes. The formant data for large sets of vowel allophones is efficiently stored using code books of formant parameters selected using vector quantization methods. The formant parameters for each vowel allophone are specified, in part, by indices pointing to formant parameters in the code books.

23 Claims, 7 Drawing Sheets

TEXT TO SPEECH SYNTHESIS SYSTEM AND METHOD USING CONTEXT DEPENDENT VOWEL ALLOPHONES

The present invention relates generally to speech synthesis, and particularly to methods and systems for converting textual data into synthetic speech.

BACKGROUND OF THE INVENTION

The automatic conversion of text to synthetic speech is commonly known as text to speech (TTS) conversion or text to speech (TTS) synthesis. A number of different techniques have been developed to make TTS conversion practical on a commercial basis. An excellent article on the history of TTS development, as well as the state of the art in 1987, is Dennis H. Klatt, Review of text-to-speech conversion for English, Journal of the Acoustical Society of America vol. 82(3), September 1987, hereby incorporated by reference. A number of commercial products use TTS techniques, including the Speech Plus Prose 2000 (made by the assignee of the applicants), the Digital Equipment DECTalk, and the Infovox SA-101.

Overview of Prior Art TTS

Referring to FIG. 1 most commercial TTS products first convert text into a stream of phonemes (with representations for emphasis and stress) and then use a "synthesis by rule" technique for converting the phonemes into synthetic speech. For example, in the Speech Plus Prose 2000 Text-to-Speech Converter the first step of the TTS process is text normalization (box 20), which expands abbreviations to their full word form. The Text Normalization routine 20 expands numbers, monetary amounts, punctuation and other non-alphabetic characters into their full word equivalents.

Most words are converted to phonemes by a set of Word to Phoneme Rules 24. However, the pronunciation of some words do not follow the standard rules. The phoneme strings for these special words are stored in a Dictionary Look-Up Table 22. In a typical TTS system, 3000 to 5000 such words are stored in the Dictionary 22. Thus, using either the Dictionary 22 or the Phoneme Rules 24 for each particular word, all text input is converted into phoneme strings.

The Word-Level Stress Assignment routine 26 assigns stress to phonemes in the phoneme string Variations in assigned stress result in pitch and duration differences that make some sounds stand out from others.

It is well known that the pronunciation of phonemes in human (or natural) speech is context dependent. To mimic natural speech, the synthetic pronunciation of each phoneme is determined by a set of rules which analyze the phonetic context of the phoneme. The Allophonics routine 28 assigns allophones to at least a portion of the consonant phonemes in the phoneme string 25.

Allophones are variants of phonemes based on surrounding speech sounds. For instance, the aspirated "p" of the word pit and the unaspirated "p" of the word spit are both allophones of the phoneme "p".

One way to try to make synthetic speech sound more natural is to "assign" or generate allophones for each phoneme based on the surrounding sounds, as well as the speech rate, syntactic structure and stress pattern of the sentence. Some prior art TTS products, such as the Speech Plus Prose 2000, assign allophones to certain consonant phonemes based on the context of those phonemes. In other words, an allophone is selected for a particular consonant phoneme based on the context of that phoneme in a particular word or sentence.

The Sentence-Level Prosodics rules 30 in the Speech Plus Prose 2000 determine the duration and fundamental frequency pattern of the words to be spoken. The resultant intonation contour gives sentences a semblance of the rhythm and melody of a human speaker. The prosodics rules 30 are sensitive to the phonetic form and the part of speech of the words in a sentence, as well as the speech rate and the type of the prosody selected by the user of the system.

The Parameter Generator 40 accepts the phonemes specified by the early portions of the TTS system, and produces a set of time varying speech parameters using a "constructive synthesis" algorithm. In other words, an algorithm is used to generate context dependent speech parameters instead of using pieces of prestored speech. The purpose of the constructive synthesis algorithm is to model the human vocal tract and to generate human sounding speech.

The speech parameters generated by the Parameter Generator 40 control a digital signal processor known as a Formant Synthesizer 42 because it generates signals which mimic the formants (i.e., resonant frequencies of the vocal tract) characteristic of human speech. The Formant Synthesizer outputs a speech waveform 44 in the form of an electrical signal that is used to drive a audio speaker and thereby generates audible synthesized speech.

Diphone Concatenation

Another technique for TTS conversion is known as diphone concatenation. A diphone is the acoustic unit which spans from the middle of one phoneme to the middle of the next phoneme. TTS conversion systems using diphone concatenation employ anywhere from 1000 to 8000 distinct diphones. In diphone concatenation systems, each diphone is a stored as a chunk of encoded real speech recorded from a particular person. Synthetic speech is generated by concatenating an appropriate string of diphones. Due to the fact that each diphone is a fixed package of encoded real speech, diphone concatenation has difficulty synthesizing syllables with differing stress and timing requirements. While some experimental diphone concatenation systems have good voice qualities, the inherent timing and stress limitations of concatenation systems have limited their commercial appeal. Some of the limitations of diphone concatenation systems may be overcome by increasing the number of diphones used so as to include similar diphones with different durations and fundamental frequencies, but the amount of memory storage required may be prohibitive.

A similar technique, called demisyllable concatenation employs demisyllables instead of diphones. A demisyllable is the acoustic unit which spans from the start of a consonant to the middle of the following vowel in a syllable, or from the middle of a vowel to the end of the following consonant in a syllable.

One reason for the prevalence of TTS systems which use "synthesis by rule" techniques, as opposed to diphone or demisyllable concatenation systems, is that synthesis by rule provides a greater ability to vary timing, intonation and allophonic detail—all of which are important to making synthetic speech intelligible, variable and pleasant to listen to. In addition, it has been demonstrated that the synthesis of phonemes follows certain patterns that can be generalized and represented by a set of rules.

Generally, diphone concatenation systems and synthesis by rule systems have different strong points and weaknesses. Diphone concatenation systems can sound like a person when the proper diphones are used because the speech produced is "real" encoded speech recorded from the person that the system is intended to mimic. Synthesis by rule systems are more flexible in terms of stress, timing and intonation, but have a machine-like quality because the speech sounds are synthetic.

The present invention can be thought of as a hybrid of the synthesis by rule and diphone concatenation techniques. Instead of using encoded (i.e., stored real speech) diphones, the present invention incorporates into a synthesis by rule system vowel allophones that are synthetic, but which resemble the full allophonic repertoire of a particular person.

Vowel Allophones

To a large degree, the prior art TTS systems and techniques generate allophones only for consonant phonemes. Vowel phonemes are generally given a static representation (i.e., are represented by a fixed set of formant frequency and bandwidth values), with "allophones" being formed by "smoothing" the vowel's formants with those of the neighboring phonemes.

More precisely, the fixed representation of each vowel phoneme is a partial set of formant frequency and bandwidth values which are derived by analyzing and selecting or averaging the formant values of one or more persons when speaking words which include that vowel phoneme. Vowel allophones (i.e., context dependent variations of vowel phonemes) are generated in the prior art systems, if they are generated at all, by formant smoothing. Formant smoothing is a curve fitting process, by which the back and forward boundaries of the vowel phoneme (i.e., the boundaries between the vowel phoneme and the prior and following phonemes) are modified so as to smoothly connect the vowel's formants with those of its neighbors.

The present invention, on the other hand, stores an encoded form of every possible allophone, in the English (or any other) language. While this would appear to be impractical, at least from a commercial viewpoint, the present invention provides a practical method of storing and retrieving every possible vowel allophone. More specifically, a vowel allophone library is used to store distinct allophones for every possible vowel context. When synthesizing speech, each vowel phoneme is assigned an allophone by determining the surrounding phonemes and selecting the corresponding allophone from the vowel allophone library.

The inventors have found that using a large library of encoded vowel allophones, rather than a small set of static vowel phonemes, greatly improves the intelligibility and naturalness of synthetic speech. It has been found that the use of encoded vowel allophones reduces the machine-like quality of the synthetic speech generated by TTS conversion.

In the context of FIG. 1, the inventors have improved the parameter generator 40 of the prior art Speech Plus Prose 2000 system by adding a vowel allophone capability. Thus the generation of vowel allophones is handled separately from the generation of consonant allophonics by Allophonics module 28.

More generally, though, the invention does not depend on the exact TTS technique being used in that it provides a system and method for replacing the static vowel phonemes in prior art TTS systems with context dependent vowel allophones.

It is therefore a primary object of the present invention to improve the quality and intelligibility of the synthetic speech produced by TTS conversion systems.

Another object of the present invention is to improve the quality and intelligibility of synthetic speech produced by TTS conversion systems by generating context dependent vowel allophones.

Another object of the present invention is to provide a large library of vowel allophones and a technique for assigning allophones in the library to the vowel phonemes in a phrase that is to be synthetically enunciated, so as to generate natural sounding vowel phonemes.

Another object of the present invention is to provide a TTS conversion system that sounds like a particular person. A related object is provide a methodology for adapting TTS conversion systems to make them sound like particular individuals.

Yet another object of the present invention is to provide a practical method and system for storing and retrieving a large library of vowel allophones, representing all or practically all of the vowel allophones in a particular language, so as enable use of the present invention in commercial applications.

SUMMARY OF THE INVENTION

In summary, the present invention is a text-to-speech synthesis system and method that incorporates a library of predefined vowel allophones, each vowel allophone being represented by a set of formant parameters. A specified text string; is first converted into a corresponding string of consonant and vowel phonemes. Vowel allophones are then selected and assigned to vowel phonemes in the string of phonemes, each vowel allophone being selected on the basis of the phonemes preceding and following the corresponding vowel phoneme.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 2:
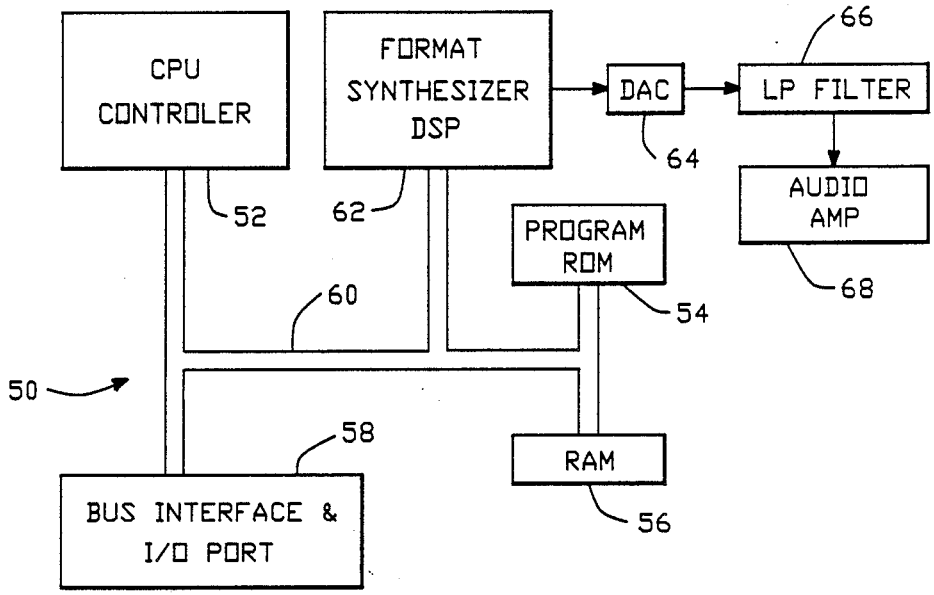
PRIOR ART FIG.-2
FIG. 2 is a block diagram of a system for performing text to speech conversion.

Referring to FIG. 2, the preferred embodiment of the present invention is a reprogrammed version of the Speech Plus Prose 2000 product, which is a TTS conversion system 50. The basic components of this system are a CPU controller 52 which executes the software stored in a program ROM 54. Random Access Memory (RAM) 56 provides workspace for the tasks run by the CPU 52. Information, such as text strings, is sent to the TTS conversion system 50 via a Bus Interface and I/O Port 58. These basic components of the system 50 communicate with one another via a system bus 60, as in any microcomputer based system.

Figure 1:
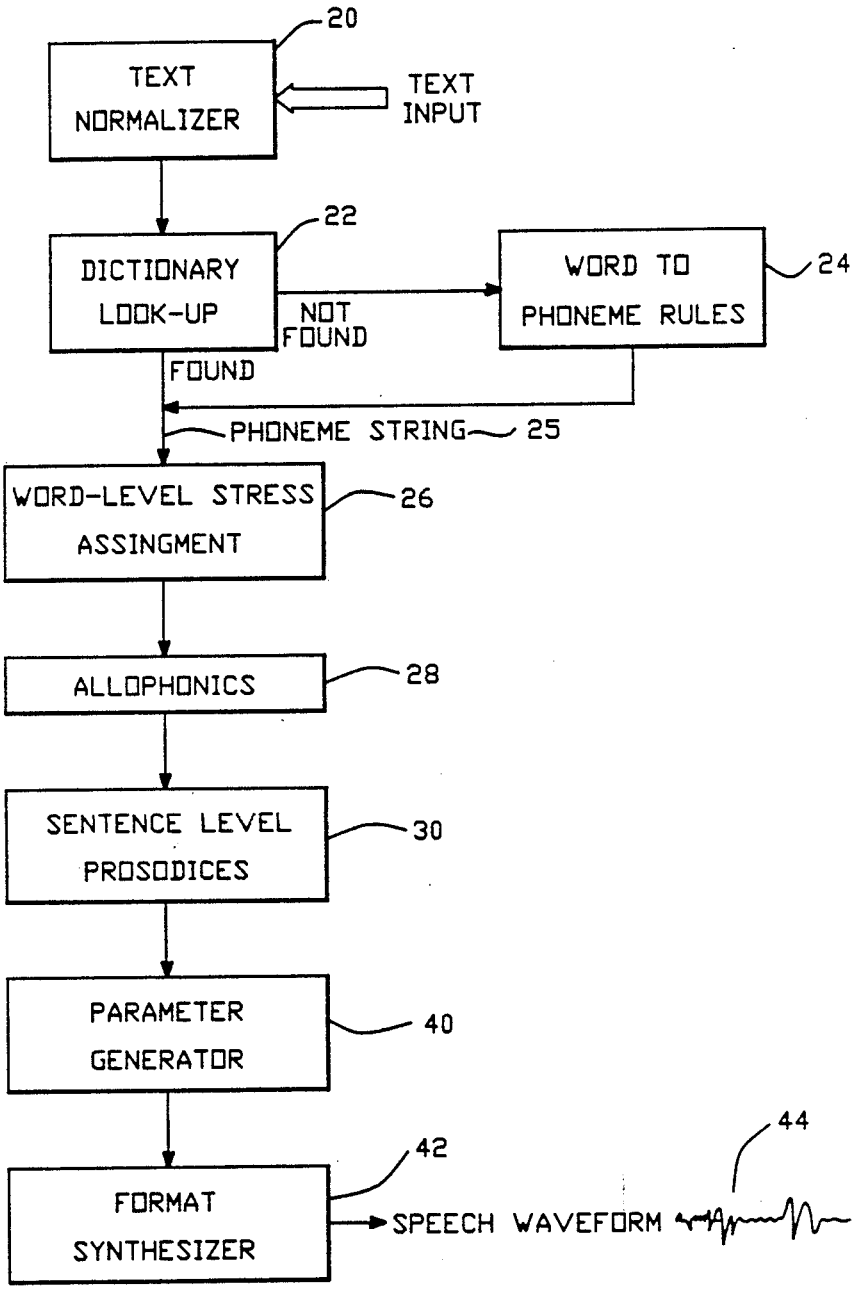
PRIOR ART FIG.-1
FIG. 1 is a flow chart of the text to speech conversion process.

Note that boxes 20 through 40 in FIG. 1 comprise a computer (represented by boxes 52, 54 and 56 in FIG. 2) programmed with appropriate TTS software. It is also noted that the TTS software may be downloaded from a disk or host computer, rather than being stored in a Program ROM 54.

Also coupled to the system bus 60 is a Formant Synthesizer 62, which is a digital signal processor that translates formant and other speech parameters into speech waveform signals that mimic human speech. The digital output of the Formant Synthesizer 62 is converted into an analog signal by a digital to analog converter 64, which is then filtered by a low pass filter 66 and amplified by an audio amplifier 68. The resulting synthetic speech waveform is suitable for driving a standard audio speaker.

The present invention synthesizes speech from text using a variation of the process shown in FIG. 1 In the preferred embodiment vowel allophones are assigned to vowel phonemes by an improved version of the parameter generator 40. In terms of the sequence of process steps, the vowel a11ophone assignment process takes place between blocks 30 and 40 in FIG. 1.

As explained above, the present invention generates improved synthetic speech by replacing the fixed formant parameters for vowel phonemes used in the prior art with selected formant parameters for vowel allophones The vowel allophones are selected on the basis of the "context" of the corresponding phoneme—i.e., the phonemes preceding and following the vowel phoneme that is being processed To understand the magnitude of this task, consider the following. Assume for the purposes of this example that the context of a vowel phoneme is defined solely by the phonemes immediately preceding and following the vowel phoneme. The preferred embodiment of the invention uses 57 phonemes (including 23 vowel phonemes, 3 consonant phonemes, and silence). For each vowel (i.e., vowel phoneme) there are 3136 (i.e., $56 \times 56$) possible phonemevowel-phoneme (PVP) contexts. In other words, there are 3136 possible allophones for each of the 23 vowel phonemes, or a total of 72,128 vowel allophones.

In the preferred embodiment, and many commercial products, the enunciation of a vowel phoneme is represented by four formants, requiring approximately 40 bytes to store each vowel allophone. The data structure for storing a single phoneme enunciation (i.e., allophone) is described in more detail below. Without using some form of data compression, it would require nearly three megabytes of memory to store the 72,128 possible vowel allophones. In most commercial applications, it is currently not practical to use so much memory just to store a library of vowel allophones It should be noted that in many commercial applications, a TTS system is an "add-on board" which must occupy a relatively small amount of space and must cost less than a typical desktop computer.

The present invention provides a practical and relatively low cost method of storing and accessing the data for all 72,128 vowel allophones, using allophone data tables which occupy about one tenth of the space which would be required in a system that did not use data compression Before explaining how this is done, it is first necessary to review the data used to represent vowel allophones

Speech Formant Parameters

Figure 3:
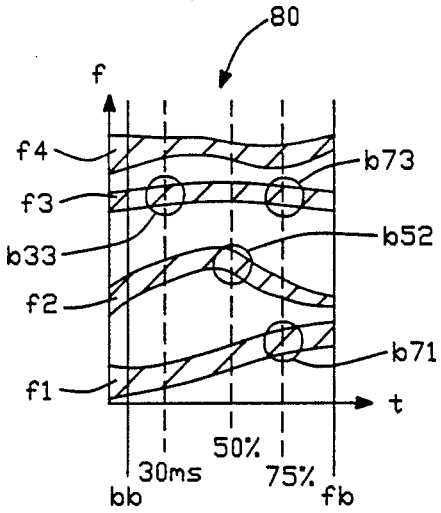
FIG. 3 depicts a spectrogram showing one vowel allophone.

FIG. 3 shows a somewhat simplified example of the speech spectrogram 80 for one vowel allophone. The speech spectrogram 80 shows four formants f1, f2, f3 and f4. As shown, each formant has a distinct frequency "trajectory", and a distinct bandwidth which varies over the duration of the allophone. The frequency trajectory and bandwidth of each formant directly correlate with the way that formant sounds.

To store and retrieve any sound, one can simply record the sound wave and play it back. However, that is not practical when building a library of over 72,000 allophones because of the huge volume of memory which could be required to store the digital samples.

Rather, speech waveforms can be reconstructed from information stored in a much more compressed form because of knowledge about their structure and production In particular, one standard method of reconstructing a speech waveform is to record the frequency trajectory of each formant, plus the bandwidth trajectory of at least the lower two or three formants. Then the waveform is synthesized by using the frequency and bandwidth trajectories to control a formant synthesizer. This method works because the formant frequencies are the resonant frequencies of the vocal tract and they characterize the shape of the vocal tract as it changes to produce the speech waveform.

Figure 4:
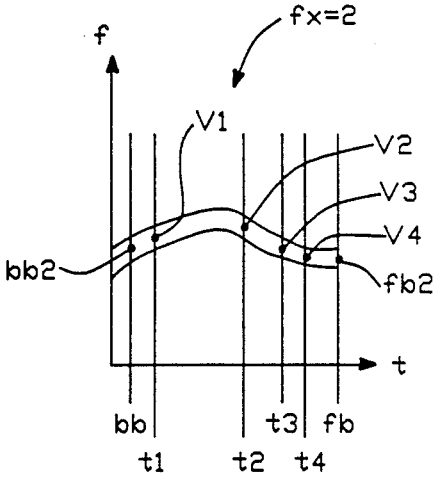
FIG. 4 depicts one formant of a vowel allophone.

Referring to FIGS. 3 and 4, in the present invention each individual allophone formant is represented by six frequency measurements (bbx, v1x, v2x, v3x, v4x and fbx), four time measurements (t1x, t2x, t3x and t4x), and three bandwidth measurements (b3x, b5x and b7x), where "x" identifies the formant These measurements trace the frequency trajectory of the formant, as well as changes in its bandwidth.

Table 1 lists the measurement parameters for a single allophone formant and describes the measured quantity represented by each parameter.

Table 2 lists the full set of parameters for an allophone. As shown, this includes the parameters for four formants. Note that no bandwidth parameters are included for the fourth formant f4. The bandwidth of the fourth formant is treated as a constant value as it varies little compared with the bandwidth of the other three formants.

TABLE 1

DATA FOR ONE ALLOPHONE FORMANT (x)

| Parameter | Description |
|---|---|
| bbx | frequency at back boundary of allophone |

TABLE 1-continued

| DATA FOR ONE ALLOPHONE FORMANT (x) | |
|---|---|
| Parameter | Description |
| v1x | frequency at time t1 |
| t1x | time of measurement v1 |
| v2x | frequency at time t2 |
| t2x | time of measurement t2 |
| v3x | frequency at time t3 |
| t3x | time of measurement v3 |
| v4x | frequency at time t4 |
| t4x | time of measurement v4 |
| fbx | frequency at forward boundary of allophone |
| b3x | bandwidth 30 milliseconds after back boundary |
| b5x | bandwidth 50 percent of the way through the duration of the allophone |
| b7x | bandwidth 70 percent of the way through the duration of the allophone |

TABLE 2

| DATA FOR ONE ALLOPHONE - FOUR FORMANTS | |
|---|---|
| FORMANT | Parameters |
| 1 | bb1, v11,t11, v21,t21, v31,t31, v41,t41, fb1, b31, b51, b71 |
| 2 | bb2, v12,t12, v22,t22, v32,t32, v42,t42, fb2, b32, b52, b72 |
| 3 | bb3, v13,t13, v23,t23, v33,t33, v43,t43, fb3, b33, b53, b73 |
| 4 | bb4, v14,t14, v24,t24, v34,t34, v44,t44, fb4 |

DATA COMPRESSION

Using Vector Quantization

To store the parameters listed in Table 2 for a single allophone requires 38 bytes: 8 bytes for the eight forward and back boundary values, 16 bytes for the sixteen intermediate frequency values, 8 bytes for the sixteen intermediate time values (4 bits each), and 6 bytes for the three sets of bandwidth values. Table 3 shows how each measurement value is scaled so as to enable this efficient representation of the data for one allophone. Using more standard, less efficient, representations of the formants would require fifty two or more bytes of data for each allophone.

TABLE 3

| FORMANT DATA SCALING | | |
|---|---|---|
| Parameter(s) | # Bits Used* | Scaling |
| ALLOPHONE DATA TABLES: | | |
| bb1, fb1 | 8 | value/4 |
| bb2, fb2 | 8 | (value-500)/8 |
| bb3, fb3 | 8 | value/16 |
| bb4, fb4 | 8 | value/16 |
| b3 | 6 | value/8 |
| b5 | 5 | value/12 |
| b7 | 5 | value/12 |
| FX1 | 10 | code book 1 index value |
| FX2 | 9 | code book 2 index value |
| FX3 | 7 | code book 3 index value |
| FX4 | 6 | code book 4 index value |
| CODE BOOK VALUES: | | |
| v11 thru v41 | 8 | value/4 |
| v12 thru v42 | 8 | (value-500)/8 |
| v13 thru v43 | 8 | value/16 |
| v14 thru v44 | 8 | value/16 |
| t11 thru t44 | 4 | percentage of duration of measured allophone, divided by 2 |

*number of bits used for each parameter

Note that the amount of data storage needed to store the formant parameters for 72,128 vowel allophones, at 38 bytes per allophone, is 2,740,864 bytes.

Formant Code Books

The present invention reduces the amount of data storage needed in two ways (1) by using vector quantization to more efficiently encode the "intermediate" portions of the formants (i.e., v1 through v4 and t1 through t4), and (2) denoting "duplicate" allophones with virtually identical formant parameter sets. This section describes the vector quantization used in the preferred embodiment.

Figure 5:
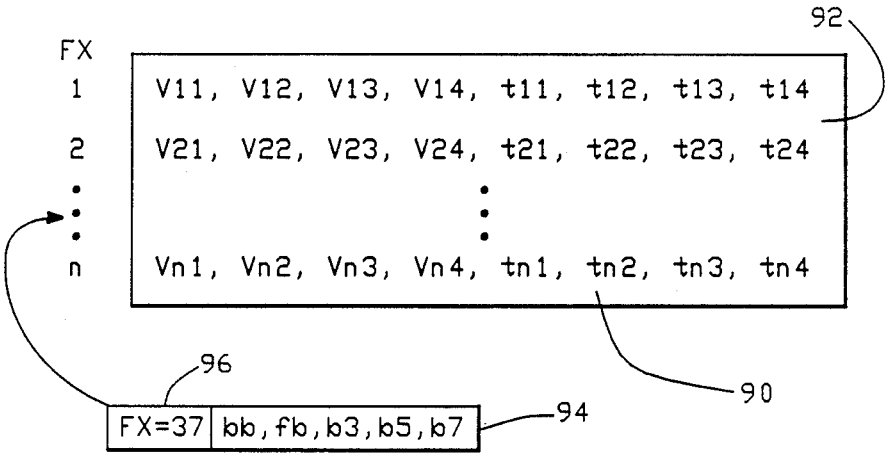
FIG. 5 is a block diagram of one formant code book and an allophone with a pointer to an item in the code book.

FIG. 5 depicts a data structure herein called the code book 90 for one formant Since each allophone is modelled as having four formants, the TTS system uses four code books 90*a*–90*d*, as will be discussed in more detail below.

For the purposes of this example, assume that the code book 90 in FIG. 5 has 1000 rows of data. Each entry or row 92 contains the intermediate data values for one allophone formant: v1 though v4 and t1 through t4, as defined in Table 1.

Using the code book 90, the data 94 representing one allophone formant is now reduced to forward and back boundary values bb and fb, three bandwidth values b3, b5 and b7, and a pointer 96 to one entry (i.e., row) in the code book. Thus the amount of data storage required to store one allophone formant is now five bytes: one for the pointer 96, two for the boundary values and two for the bandwidth values. For the fourth formant, the amount of storage required is three bytes because no bandwidth data is stored. Without the code book 90, the amount of storage required was ten bytes per formant, and eight for the fourth formant.

Thus, if the code book 90 is considered to be a "fixed cost", the amount of storage for each allophone formant is reduced by half through the use of the code book. To show that this is a valid measurement of data compression consider the following. If code books are not used, the amount of data storage required to store the intermediate frequency and time values for 72,128 allophones is 24 bytes per allophone, or a total of 1,731,072 bytes. Four code books with an average of 1000 entries each occupy 24,000 bytes. Storing 72,128 allophones, using four one-byte code book pointers per allophone, requires 288,512 bytes to store the pointers, plus 24,000 bytes for the code books, for a total 312,512 bytes—as compared to 1,731,072 bytes without compression. This represents a compression ratio of about 5.5:1.

The next issue is deciding which data values to store in the code book 90 for each formant. In other words, we must choose the 1000 items 92 in the code book 90 wisely so that there will be an appropriate entry for every allophone in the English language.

Figure 6:
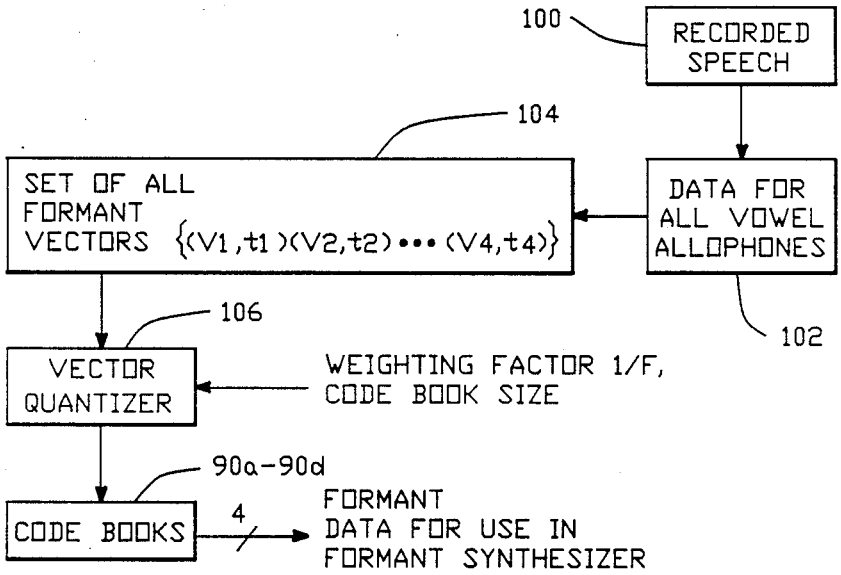
FIG. 6 is a block diagram of the vector quantization process for generating a code book of vowel allophone formant parameters.

Referring to FIG. 6, the four code books 90*a*–90*d* for the four formants f1–f4 are generated as follows. First, the speech of a single, selected person is recorded 100 while speaking each and every vowel allophone in the English (or another selected) language. Next, the recorded speech is digitized and processed to produce a spectrogram 102 for each vowel allophone. Then, trained technician selects representative formant frequency values from the formant trajectories of each vowel allophone. The result of this process is formant frequency nd time data 104 for each of four formants for each of the vowel allophones in the English language. Of course, the process being described here can be performed with data from just a subset of the vowel allophones.

It is noted that the TTS system 50 can be made to mimic any selected person, selected dialect, or even a selected cartoon character, simply by recording a person with the desired speech characteristics and then processing the resulting data.

There is a well-known technique, called vector quantization, for "mapping" a sequence of continuous or discrete vectors into a smaller representative set of vectors. For a description of how vector quantization works, see Robert M. Gray, "Vector Quantization", IEEE ASSP Magazine, pp. 4–29, April 1984, hereby incorporated by reference. Suffice it to say that given a set of 288,512 (i.e., 4 * 72,128) vectors (box 104 in FIG. 6) of the form:

$$(v1,t1)\ (v2,t2)\ (v3,t3)\ (v4,t4)$$

vector quantization can be used to generate the set of X vectors which produce the minimum "distortion". Given any value of X, such as 4000, the vector quantization process 106 will find the "best" set of vectors. This best set of vectors is called a "code book", because it allows each vector in the original set of vectors 104 to be represented by an "encoded" value—i.e., a pointer to the most similar vector in the code book.

Generally, the best set of vectors is one which minimizes a defined value, called the distortion. In the preferred embodiment, the vector quantizer 106 implements a "minimax" method which selects a specified number of code book vectors from the set of all vowel allophone vectors such that the maximum weighted distance from the vectors in the set of vowel allophone vectors to the nearest code book vectors is minimized. The weighted distance between two vectors is computed as the area between the corresponding formant trajectories multiplied by 1/F, where F is the average of the forward and backward boundary values for the two trajectories. The distance is weighted by 1/F to give greater importance to lower frequencies, because lower frequencies are more important than higher ones in human perception of speech. It has been discovered that the minimax method results in higher quality speech than does an alternative method that minimizes the average of the distances from the vowel allophone vectors to their nearest code book vectors. See Eric Dorsey and Jared Bernstein, "Inter-Speaker Comparison of LPC Acoustic Space Using a Minimax Distortion Measure," Proc. IEEE Int'l Conf. Acoustics, Speech and Signal Processing (1981) for a discussion of minimax distortion vector quantization as applied to LPC encoded speech.

The vector quantization is performed once on the entire set of vowel allophone vectors representing data for all four formants to generate four formant code books **90*a*–90*d* with a total specified size, such as 4000 rows, for the four code books. In other words, to form code book 90*a*, the selected vectors that represent formant f1 are stored in that code book. Similarly, selected vectors for formants f2, f3 and f4 are stored in code books 90*b*, 90*c* and 90*d*, respectively. The sum n1+n2+n3+n4**, where nx is the number of vectors in the code book for formant fx, is equal to the total code book size specified when the vector quantization process is performed.

In the preferred embodiment, the number of items in each of the code books **90*a*–90*d* is different because the different formants have differing amounts of variability. In general, n1>n2>n3>n4, because use of the 1/F weighting factor gives lessor importance to differences between vectors representing higher formants with the result that fewer vectors are selected for the higher formants. This is desirable because each higher formant is less critical to perceived vowel quality than the lower formants. In one version of the preferred embodiment the following values were used: n1=741, n2=451, n3=127 and n4=81. However, these values change when the allophone data is changed (e.g., when new allophone data is added). In the preferred embodiment n1+n2+n3+n4** is set to a fixed size, such as 1400 or 4000 (depending on the number of vectors being quantized), and the quantizer sets the individual sizes to minimize the overall weighted distortion.

Once all of the code books have been generated, vector quantization is no longer used. Thus the completed TTS system need not incorporate a vector quantization capability. In the completed TTS system, each allophone is "encoded" or quantized using the four formant code books **90*a*–90*d*** with the parameters shown in Table 4.

TABLE 4

PARAMETERS FOR ONE ALLOPHONE

| Parameter(s) | Description |
|---|---|
| FX1–FX4 | indices to entries in formant code books 1, 2, 3 and 4 |
| bb1–bb4 | frequency at back boundary of allophone for formants 1–4 |
| fb1–fb4 | frequency at forward boundary of allophone for formants 1–4 |
| b31–b33 | bandwidth 30 milliseconds after back boundary for formants 1–3 |
| b51–b53 | bandwidth 50 percent of the way through the duration of the allophone, for formants 1–3 |
| b71–b73 | bandwidth 70 percent of the way through the duration of the allophone, for formants 1–3 |
| LLRRx | index into LLRR Context Table |
| LLRRd | index into LLRR Allophone Data Table for corresponding vowel phoneme |

It should be noted that in the preferred embodiment, the formant data in the code books **90*a*–90*d*** is derived from the speech of a single person, though the data for any particular vowel allophone may represent the most representative of several enunciations of the vowel allophone. This is different from most TTS synthesis systems and methods in which the formant and bandwidth data stored to represent phonemes is data which represents the "average" speech of a number of different persons. The inventors have found that the averaging of speech data from a number of persons tends to average out the tonal qualities which are associated with natural speech, and thus results in artificial sounding synthetic speech.

Generating Vowel Allophones

When converting text to speech using the present invention, vowel phonemes are converted into vowel allophones using the process shown in FIGS. 7 through 10. It is to be noted that the process of converting vowel phonemes is performed between boxes 30 and 40 in the flow diagram of FIG. 1. Thus, at the beginning of this process, the phonemes preceding and following the vowel phoneme to be converted (the currently "selected" vowel phoneme) are known.

For the purposes of this discussion, it should be understood that the term "vowel allophone" refers to the particular pronunciation of a vowel phoneme as determined by its neighboring phonemes. As explained below, there is conceptually a distinct allophone for every PVP context of the vowel phoneme V. However, some allophones are perceptually indistinguishable from others. For this reason, some vowel allophones are labelled "duplicate" allophones. To save on memory storage, the formant data representing such duplicate allophones is not repeated.

Many vowels are diphthongs, gliding speech sounds that start with the acoustic characteristics of one vowel and move toward having those of another. The second part of a diphthong is called an "offglide". There are just a few, common offglides, so vowels fall into a few groups that have a common offglide, and therefore a common effect on a following phoneme. This has enabled the inventors to group preceding and following vowels into a few categories and to simplify the present invention to store and process 1156 (i.e , 34×34) CVC (i.e., consonant-vowel-consonant) contexts plus several CVV (i.e., consonant-vowel-vowel), VVC (i.e., vowel-vowel-consonant) and VVV (vowel-vowel-vowel) contexts for each vowel phoneme instead of all 3136 (i.e., 56×56) PVP (phoneme-vowel-phoneme) contexts for each vowel.

Figures 7A, 7C:
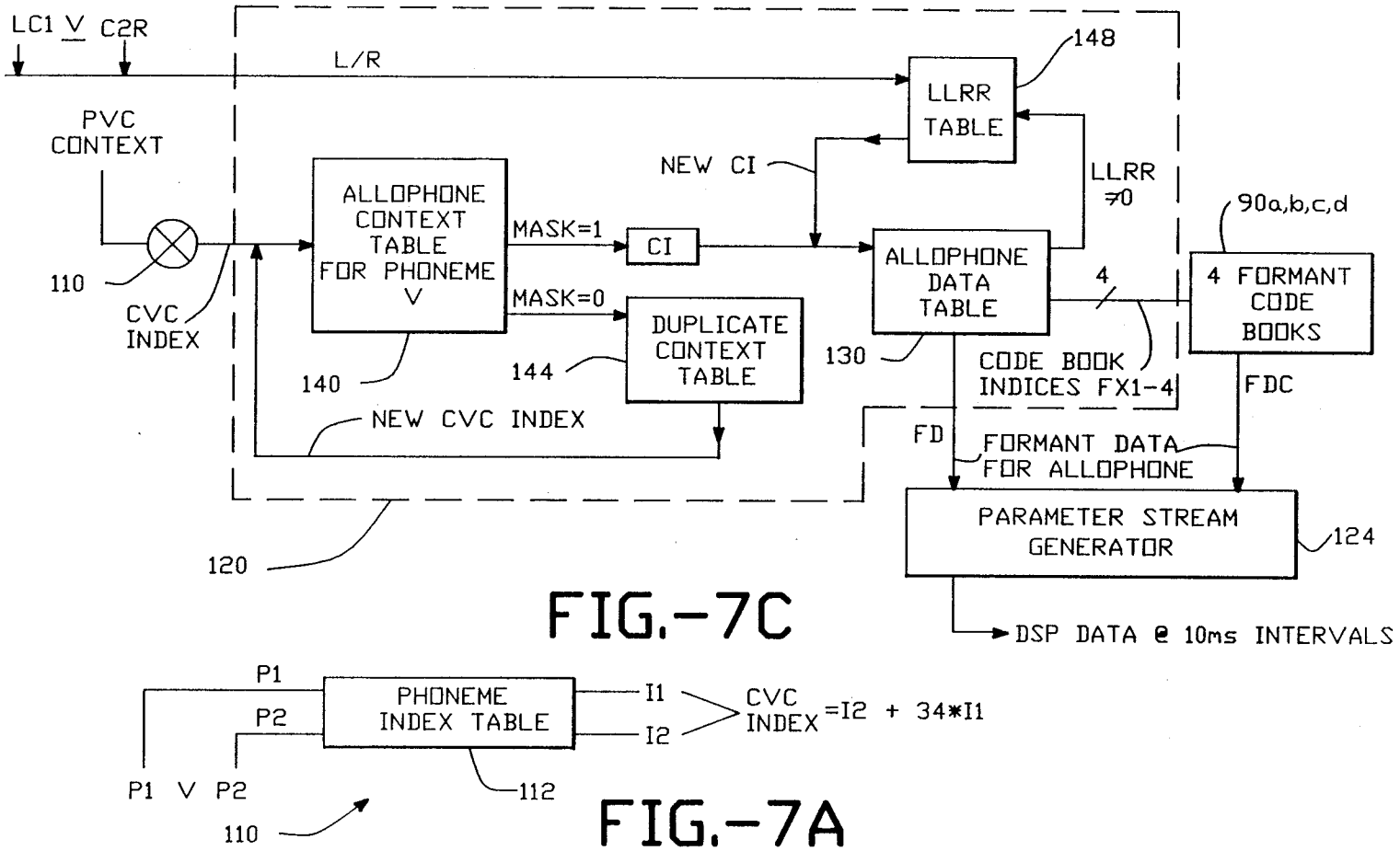
FIGS. 7A, 7B and 7C are block diagrams of the process for generating the formant parameters for a specified vowel allophone.

Referring to FIG. 7A, the first step of the vowel phoneme conversion process is to determine the context of the vowel phoneme. The identity of the most appropriate vowel allophone to be used is initially determined by the identity of the phonemes preceding and following selected vowel phoneme.

FIG. 7A shows a context index calculator 110. The input data to the context index calculator 110 are the phonemes P1 and P2 preceding and following the selected vowel phoneme V. Initially we will assume that the neighboring phonemes are consonant phonemes Of course, sometimes one of both of the neighboring phonemes are vowels, but we will deal with those cases separately.

The Phoneme Index Table 112 converts any phoneme into an index value between 0 and 33, i.e., one of 34 distinct values. In the preferred embodiment, there are 33 distinct consonant phonemes plus one for silence. Thus Phoneme Index Table 112 generates a unique value for each consonant phoneme, including the silence phoneme.

The Phoneme Index Table 112 is used to generate two index values I1 and I2, corresponding to the identities of the two neighboring phonemes P1 and P2, respectively The context index calculator 110 then generates a CVC index value:

$$CVC\ Index = I2 + 34 * I1$$

which uniquely identifies the "context" of a vowel phoneme —i.e , the preceding and following consonant phonemes In most cases, the CVC Index value can be used to correctly identify the vowel allophone associated with the vowel V.

When one of the neighboring phonemes is a vowel, the inventors have found that, for the purposes of selecting the most appropriate allophone, the following substitution process can be used.

TABLE 5

ALLOPHONE SUBSTITUTION TABLE FOR C-V1-V2 and V1-V2-C CONTEXTS

| V1 | REPLACE OUTER VOWEL WITH CONSONANT INDEX FOR: |
|---|---|
| /ej/, /ij/, /ai/, or /ɔi/ | /j/ |
| /ou/, /juw/, /uw/, /ɔ/, or /au/ | /w/ |
| /ɝ/, /ir/, /er/, /ur/, /ɔr/, or /ar/ | /r/ |
| /ə/, /a/, /ʌ/, /æ/, /ɛ/, /I/, /i/, or /U/ | /ʔ/ |

The PVP context is relabelled C-V1-V2, or V1-V2-C, as appropriate. To synthesize the inner vowel (V1 in the first case, V2 in the second), use the substitution values shown in Table 5 (in which phonemes are denoted using standard IPA symbols) so that a consonant is substituted for the outer vowel Then the CVC index is computed, as explained above.

To implement the vowel substitutions shown in Table 5, the Phoneme Index Table 112 includes entries for the 23 vowel phonemes The entries in the Phoneme Index Table 112 for vowel phonemes are set equal to the values for the substitute consonant phonemes specified in Table 5. Thus, the context of any and all vowel phonemes is computed simply by looking up the index values for the neighboring phonemes (regardless of whether they are consonants or vowels) and then using the CVC index formula shown above.

It is to be noted that the "substitution" represented in Table 5 is used solely for the purpose of generating a CVC index value to represent the context of the selected vowel phoneme V. The original "outer vowel" is used when synthesizing the outer vowel.

Thus, at this point, whether the neighboring phonemes are consonants or vowels, we have a CVC index value representing the context of a selected vowel phoneme V.

Figure 7B:
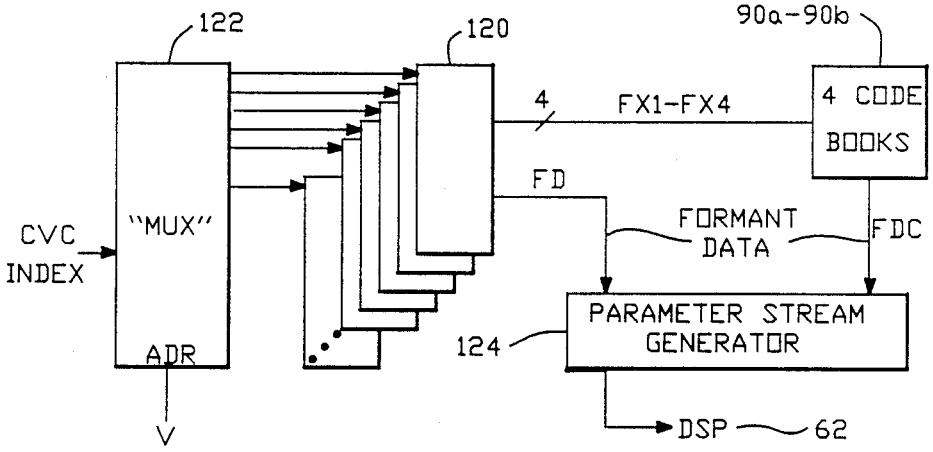

Referring to FIG. 7B, the formant parameters for a selected vowel phoneme V are generated as follows. There are 23 vowel phoneme-to-allophone decoders 120, one for each of the 23 vowel phonemes As will be described in more detail, each vowel phoneme-to-allophone decoder 120 stores encoded data representing all of the vowel allophones for the corresponding vowel phoneme.

Whenever a vowel phoneme is encountered in the string of phonemes that is being synthesized, the data for the corresponding allophone is generated as follows. First, the CVC index for the context of the vowel phoneme is calculated, as described above with reference to FIG. 7A. Then, the CVC index is sent by a software multiplexer 122 to the allophone decoder 120 for the corresponding vowel phoneme V.

The selected allophone decoder 120 outputs four code book index values FX1–FX4, as well as a set of formant data values FD which will be described below The allophone decoder 120 is shown in more detail in FIG. 7C. The code books **90*a*–90*d*** output formant data FDC representing the central portions of the four speech formants for the selected vowel allophone.

The combined outputs FD and FDC are sent to a parameter stream generator 124, which outputs new formant values to the formant synthesizer 62 (shown in FIG. 2) once every 10 milliseconds for the duration of the allophone, thereby synthesizing the selected allophone. More generally, the parameter stream generator 124 continuously outputs formant data every 10 milliseconds to the formant synthesizer, with the formant data representing the stream of phonemes and/or allophones that are selected by earlier portions of the TTS conversion process.

FIG. 7C shows one vowel phoneme-to-allophone decoder 120 As explained above, there are 23 such decoders, one for each of the 23 vowel phonemes in the preferred embodiment Thus the data stored in the decoder 120 represents the allophones for one selected vowel phoneme.

The data representing all of the allophones associated with one vowel phoneme V is stored in a table called the Allophone Data Table 130.

Figure 8:
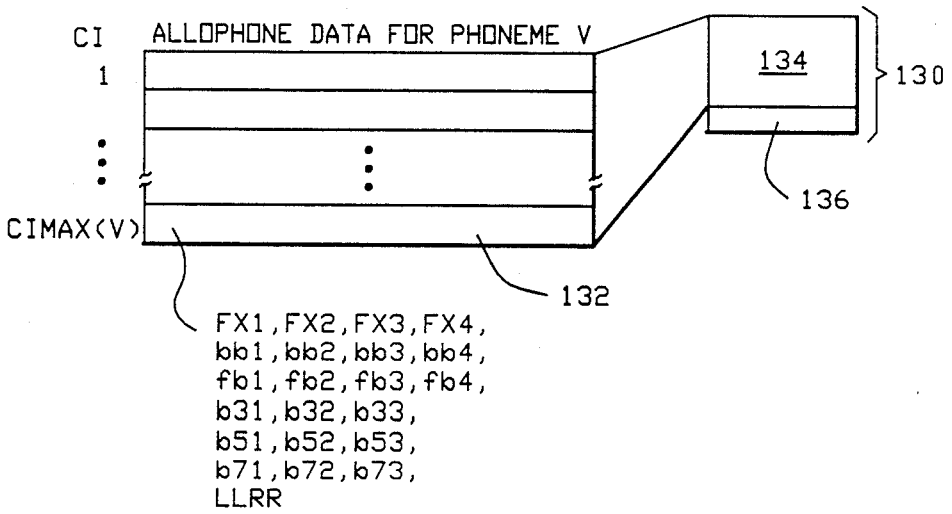
FIG. 8 depicts an allophone data table.

Referring to FIG. 8, each Allophone Data Table 130 contains separate records or entries 132 for each of a number of unique vowel allophones. Each record 132 in the Allophone Data Table 130 contains the set of data listed in Table 3, as described above. In particular, the record 132 for any one allophone contains four code book indices FX1–FX4, representing the center portions of the four formants f1–f4 for the allophone, four values bb1–bb4 representing the back boundary values of the four formants, four values fb1–fb4 representing the forward boundary values of the four formants, nine bandwidth values b31–b73 representing the bandwidths of the three lower formants f1–f3 (as shown in FIG. 3), and a value called LLRR which will be described below.

The data values in the record 132 are scaled using the scaling and compression factors listed in Table 3. As a result, each record 132 occupies 19 bytes in the preferred embodiment.

The Allophone Data Table 130 has two portions: one portion 134 for allophones identified by the PVP context (i.e., the CVC index value) of the vowel V, and a smaller portion 136 for the allophones identified by the expanded context LCVC or CVCR of the vowel V as will be explained in more detail below. The smaller portion 136, called the Extended Allophone Data Table, contains up to 16 records, each having the same formant as the records in the rest of the table 130.

While there are 1156 possible CVC contexts for each vowel phoneme V, the inventors have further reduced memory requirements by selecting a number of "distinct allophones" which sound sufficiently distinct to require storage. The number of distinct allophones represented in the preferred embodiment is around 10,000 (less than half the number of CVC contexts), with the exact number depending on the methodology used to select them. Thus many vowel allophones are perceptually similar and can be considered to be "duplicate" allophones. It is noted that the selection of distinct allophones is inherently subjective, since it based on judgments by human technicians.

Storing formant data for 26,588 allophones would require 505,172 bytes of storage (excluding the storage required for the code books 90*a*–90*d*). On the other hand, storing formant data for only the 10,000 or so distinct allophones requires about 190,000 bytes of storage—which is a significant savings of memory storage for low cost TTS systems. As a result, only the distinct vowel allophones for a selected phoneme V are stored in each Allophone Data Table 130.

Referring to FIG. 7C, the purpose of the Allophone Context Table 140, Duplicate Context Table 144, and LLRR Table 148 is to enable the use of a compact Allophone Data Table.130 which stores data only for distinct allophones. These additional tables 140, 144 and 148 are used to convert the initial CVC index value into a pointer to the appropriate record in the Allophone Data Table 130.

Figure 9:
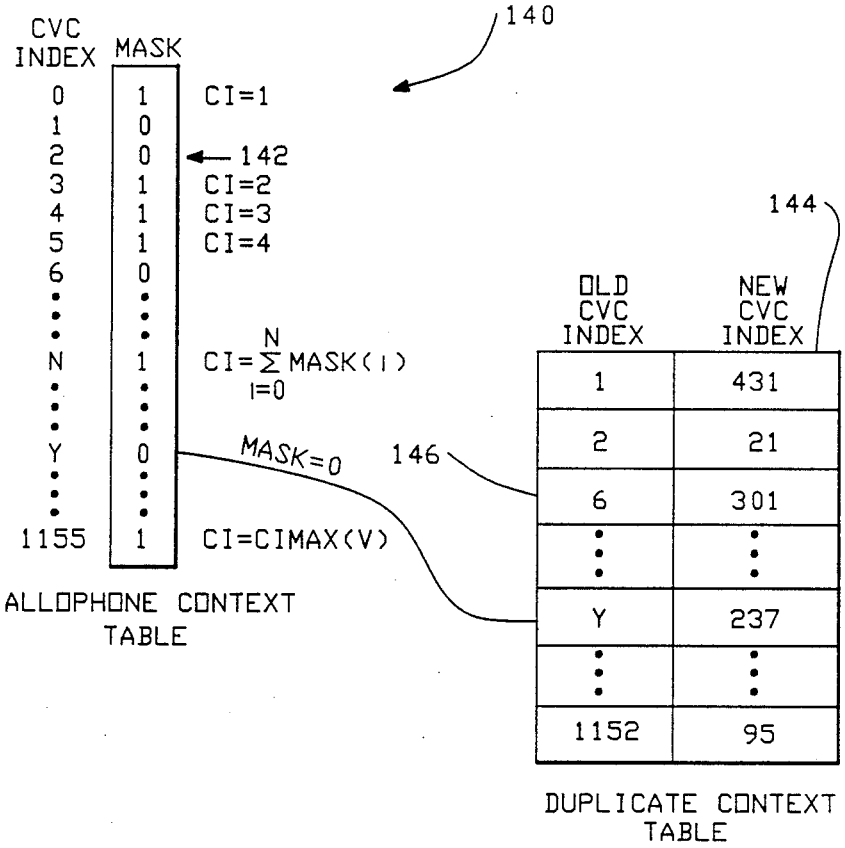
FIG. 9 is a block diagram of an allophone context map data structure and a related duplicate context map.

FIG. 9 shows an Allophone Context Table 140, for one phoneme V. The purpose of the Allophone Context Table 140 is to convert a CVC index value (calculated by the indexing mechanism shown in FIG. 7A) into a Context Index CI.

Each of the 23 Allophone Context Tables 140 contains a single Mask Bit, Mask(i), for each of the 1156 CVC contexts for a vowel phoneme V Distinct vowel allophones are denoted with a Mask Bit 142 equal to 1, and "duplicate" vowel allophones which are perceptually similar to one of the other vowel allophones are denoted with a Mask Bit of 0. Nonexistent allophones (i.e., CVC contexts not used in the English language) are also denoted with a Mask Bit equal to 0.

To find the CI index value for any particular vowel allophone, the Mask value Mask(CVC Index) is inspected. If the Mask Bit value is equal to 1, the value of CI is computed as the sum of all the Mask Bits for CVC Index values less than or equal to the selected CVC Index value:

$$CI(N) = \sum_{i=0}^{N} \text{Mask}(i)$$

where N is equal to the CVC Index value that is being converted into a CI value

The number of unique vowel allophones for the selected vowel phoneme is CIMAX(V), which is also equal to CI for the largest CVC index with a nonzero Mask Bit. CIMAX(V) is furthermore equal to the number of records 132 in the main portion 134 of the Allophone Data Table 130. Referring to FIG. 8, the number of entries 132 in the Allophone Data Table 130 is CIMAX(V) +16, for reasons which will be explained below.

If the selected Mask Bit 142 equals 0, the selected allophone is a "duplicate", and a substitute CVC index value is obtained from the Duplicate Context Table 144. The substitute CVC index value is guaranteed to have a Mask Bit equal to 1, and is used to compute a new CI index value as described above.

More particularly, to find the CI value for a particular "duplicate" allophone, the synthesizer looks through the records 146 of the Duplicate Context Table 144 for the CVC index value of the duplicate allophone When the CVC index value is found, the new CVC value in the same record replaces the original CVC index value, and the CI computation process is restarted.

As shown in FIG. 9, the Duplicate Context Table 144 comprises a list of "old" or original CVC Index Values and corresponding "new CVC" values, with two bytes being used to represent each CVC value. In other words, the Table 144 comprises a set of four byte records 146, each of which contains a pair of corresponding CVC Index and "new CVC" values. The only "old" CVC Index values included in the Duplicate Context Table 144 are those for existent allophones which have a Mask Bit value of 0 in the Allophone Context Table 140. Thus the Duplicate Context Table 144 will typically contain many fewer records 146 than there are Mask Bits 142 with values of zero. In the preferred embodiment, the number of entries in the Duplicate Context Table 144 varies from 24 to 111, depending on the vowel phoneme V.

Should the selected CVC value not be found in the Duplicate Context Table, this would mean that a previously unknown allophone context has been encountered. In this case, the TTS synthesizer synthesizes the allophone using a standard "default" context for all allophones. In an alternate embodiment, such allophones could be synthesized using the "synthesis by rule" methodology previously used in Speech Plus Prose 2000 product (described above with reference to FIG. 1).

In another embodiment of the invention, the Duplicate Context Table 144 stores the CI value for each duplicate allophone. Since the CI value occupies the same amount of storage space as a replacement CVC value, the alternate embodiment avoids the computation of CI values for those allophones which are "duplicate" allophones.

In yet another alternate embodiment of the invention, the Allophone Context Table 140 (for one vowel V) comprises a table of two byte index values CI, with one CI value for each of the 1156 possible CVC index values. By eliminating the Duplicate Context Table 144, the alternate embodiment occupies about 2000 bytes of extra storage per vowel phoneme V, but reduces the computation time for calculating CI.

Referring to FIG. 7C, we now have a CI index value which points to one record in the Allophone Data Table 130. As mentioned above, the data in each record 132 of the Allophone Data Table 130 includes an entry called LLRR. LLRR actually has two components: LLRRx (the low-order four bits) and LLRRd (the high-order four bits).

LCVC and CVCR Contexts

In a relatively small number of cases, the selection of the proper vowel allophone depends not just on the immediately neighboring phonemes, but also on the phoneme just to the left or to the right of these neighboring phonemes. The "expanded" context of selected vowel phoneme can be labelled:

LCVC or CVCR.

Thus there are multiple allophones for a small number of CVC contexts. The inventors have found that, for any one CVC context, there is at most one LCVC or CVCR context which has a distinct enunciation of the vowel allophone V. As a result, a relatively small LLRR Context Table 148 and a similarly small Extended Allophone Data Table 136 can be used to represent and store the formant data for these allophones.

The LLRRx value in each Allophone Data Table record denotes whether there is more than one allophone for the selected CVC context, and thus whether the "expanded" LCVC or CVCR context of the allophone must be considered. If LLRRx is equal to zero, the allophone data specified by the previously calculated value of CI is used. If LLRRx is not equal to zero, then an additional computation is needed.

Figure 10:
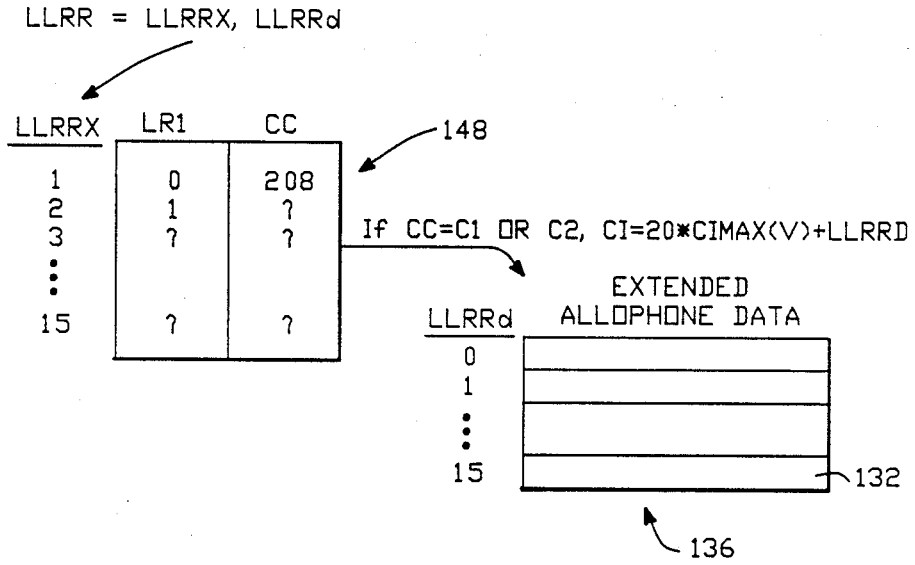
FIG. 10 is a block diagram of an alternate LLRR vowel context table.

Referring to FIG. 10, there is an LLRR Context Table 148 for each vowel phoneme V. The Table 148 contains fifteen entries or records, each of which identifies an "extended" context. More particularly, the Table 148 can denote up to fifteen Left or Right Phonemes which identify an extended LCVC o CVCR context.

Each LLRR Context Table record has two values: LRI and CC. The value of LLRRx determines which entry in the Table 148 is to be used. Note that there is no entry for LLRRx=0 because a value of zero indicates that the expanded context need not be considered.

CC denotes a phoneme value, and LRI is a "left or right" indicator. When LRI is equal to 0, the phoneme to the left of the CVC context is compared with the phoneme denoted by CC; when LRI is equal to 1, the phoneme to the right of the CVC context is compared with the CC phoneme. Only if the selected left or right phoneme matches the CC phoneme is a "new LLRR CI value" calculated.

If the selected left or right phoneme does not match the CC phoneme, then the data pointed to by CI is the data used to generate the allophone If there is a match, however, the LLRRd value acts as a pointer to a record in the extended portion 136 of the Allophone Data Table 130 shown in FIG. 8. In effect, the CI value is replaced with a value of $$CIMAX(V)+LLRRd$$

where CIMAX(V) is the number of records in the main portion 134 of the Allophone Data Table 130.

While there are only sixteen possible values of LLRRd in the preferred embodiment, in alternate embodiments a full byte could be used to represent LLRRd, allowing for a much larger number of extended context allophones. Note that there is not a one to one correspondence between the entries in the LLRR Table 148 and the Extended Allophone Data Table 136. In fact, there can be several Extended Allophone Data Table entries for a single LLRR Table entry because one LLRR Table entry can define the context of several allophones.

Allophone Synthesis Method

Referring once again to FIG. 7C, the process for synthesizing a particular vowel phoneme V is as follows. First a CVC index value is computed by the context index calculator 110. Then, using the allophone decoder 120 for the selected vowel phoneme V, a CI index value is computed using the Allophone Context Table 140 and Duplicate Context Table 144. The CI index value points to a record in the Allophone Data Table 130, which contains formant data for the allophone. However, if the LLRR value in the selected Allophone Data record has a value of LLRRx≠0, and the expanded context LCVC or CVCR matches the specified value in the LLRR Table 148, a new CI value replaces the old one and a new record of data in the Allophone Data Table 130 is used.

The data record 132 of the Allophone Data Table 130 pointed to by CI includes four pointers FX1–FX4 to records in the four formant code books **90*a*–90*d*. The data record 132** also includes back boundary and forward boundary values for the four formants, and a sequence of three bandwidth values for each of the first three formants. The formant parameters representing the four formant frequency trajectories for the vowel allophone include the data values from the four selected code book records as well as the data values in the selected Allophone Data Table record.

These formant parameters are then processed by a parameter stream generator 124. This generator 124 interpolates between the selected formant values to compute dynamically changing formant values at 10 millisecond intervals from the start of the vowel to its end. For each formant, quadratic smoothing is used from the back boundary at the start of the vowel to the first "target" value retrieved from the code book. Linear smoothing is performed between the four target values retrieved from the code book, and also between the fourth code book value and the forward boundary value at the end of the vowel.

Most contexts require smoothing of the formants backward into the preceding consonant in order to assure a continuous formant track. To do this, interpolation is done from the vowel's back boundary value to a formant value in the preceding consonant. Consonants for which this is not done are those where a discontinuity is desired in formants f2, f3 and f4, namely the nasal consonants (m, n and ng) and stop consonants (p, t, k, b, d, g).

For each formant, the bandwidth is linearly smoothed from the last bandwidth value of the preceding phoneme to the 30 ms bandwidth value b3x, then to the midpoint bandwidth value b5x, then to the 75% value b7x, and then to the boundary of the next phoneme.

Alternate Embodiments

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

In particular, it is noted that the data compression methods used in the preferred embodiment are dictated by the need to store all the vowel allophone data in a space of 256k bytes or less. If the storage space limits are relaxed, because of relaxed cost criteria or reduced memory costs, a number of simplifications of the data structures well known to those skilled in the art could be employed.

For instance, as noted above, the allophone context table 140 and duplicate context table 144 could be combined and simplified at a cost of around 45k bytes At a cost of approximately 256k, formant data can be stored for every CVC context, thereby eliminating the need for the Allophone Context Table 140 and Duplicate Context Table 144 altogether In other alternate embodiments, bandwidth values could be stored in code books much as the formant values are stored in the preferred embodiment Similarly, code books could be used to store formant parameter vectors that include the backward and forward formant boundary values (instead of the above described code books, which store vectors that include only the intermediate formant parameters). These alternate embodiments would increase the amount of data compression obtained from the use of code books, but would degrade the quality of the synthesized allophones.

It is also noted that each TTS system incorporating the present invention can store allophone data representative of the pronunciation of a selected individual, a selected dialect, a selected cartoon character, or a language other than English. The only difference between these embodiments of the present invention's vowel allophone production system is the allophone data stored in the system. In still other embodiments in which there is more memory available for allophone storage, multiple sets of allophone data could be stored so that a single TTS system could generate synthetic speech which mimics several different persons or dialects.

Finally, it is noted that in an alternate embodiment of the present invention vowel allophones could be stored using speech parameters that are based on a different representation of human speech than the formant parameters described above. It is well known to those skilled in the art that there are several alternate methods of representing synthetic speech using speech parameters other than formant parameters. The most widely used of these other methods is known as LPC (linear predictive coding) encoded speech.

Figure 11:
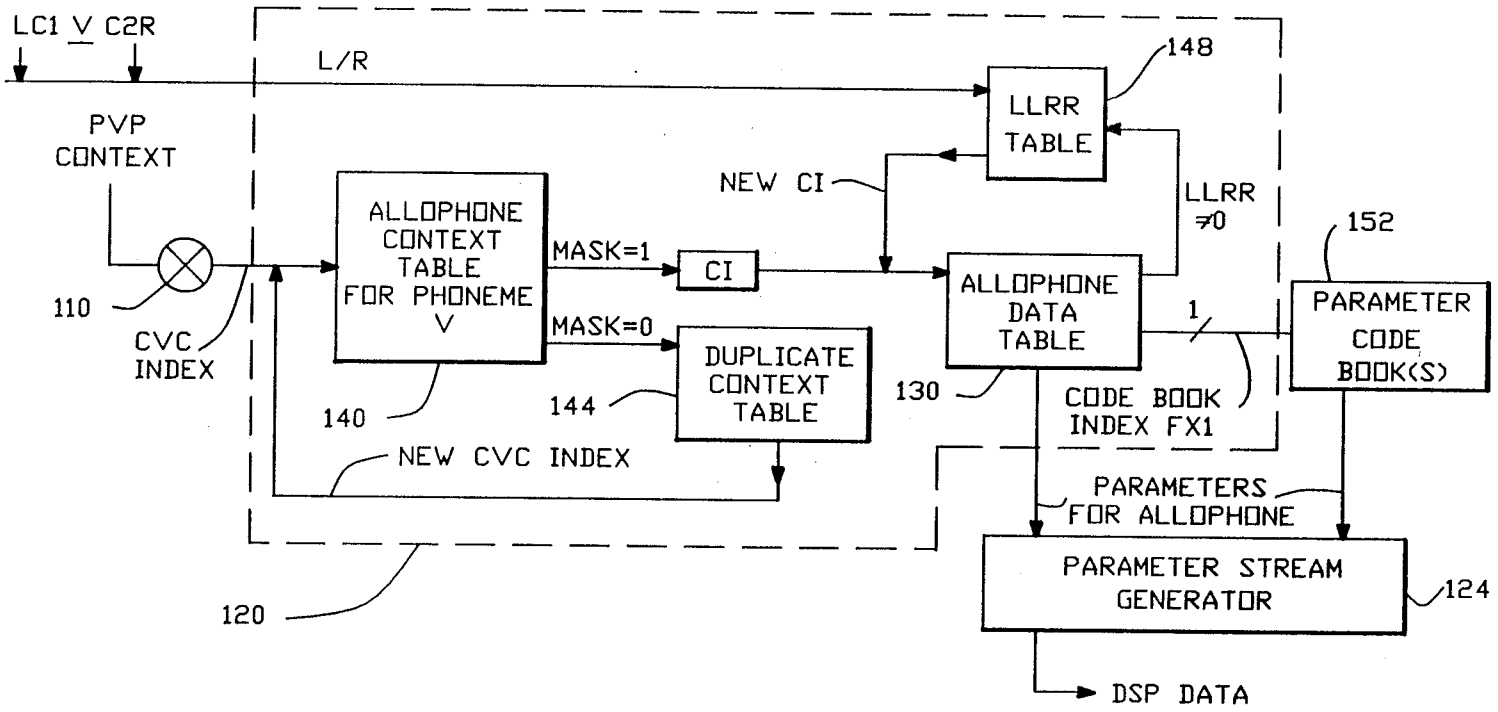
FIG. 11 is a block diagram of the process for generating speech parameters for a specified vowel allophone in an alternate embodiment of the present invention.

Referring to FIG. 11, in an alternate embodiment of the invention each distinct vowel allophone is represented by a set of stored LPC encoded data. Note that FIG. 11 is the same as FIG. 7C, except for the data and code book tables. The LPC data for each vowel allophone is a set of parameters which can be considered to be a vector. Synthetic speech is generated from LPC parameters by processing the LPC parameters with a digital signal processor (i.e., a digital filter network). While the digital signal processors used with LPC parameters are different than the digital signal processors used with formant parameters, both types of digital signal processors are well known in the prior art and can be considered to be analogous for the purposes of the present invention.

Since the LPC parameters for each vowel allophone is a vector, the amount of storage required to represent these vectors can be greatly reduced using the vector quantization scheme described above. In particular, the intermediate portions of the LPC vectors for all the vowel allophones can be processed by a minimax distortion vector quantization process, as described above, to produce the best set of N vectors (e.g., 4000 LPC vectors) for representing the intermediate portions of the LPC vectors. The resulting N vectors would be stored in a single parameter code book 152.

The LPC Allophone Data Table 150 will store forward and back LPC boundary values, bandwidth values, LLRR, and a single index into the parameter code book 152.

The methodology for selecting vowel allophones and retrieving the data representing a selected vowel allophone is unchanged from the preferred embodiment, except that now there is only one code book entry that is retrieved (instead of four). The parameters selected from the Allophone Data Table 150 and the parameter code book 152 are sent to the parameter stream generator 124 for inclusion in the stream of data sent to the synthesizer's digital signal processor.

In yet other embodiments of the present invention, other methods of representing vowel allophones with speech parameters can be used. Several such alternate methods are known to the prior art, and new parameter representations of speech may be developed in the future.

In all such alternate embodiments, the primary differences from the preferred embodiment would be in the vowel allophone data stored, and in the apparatus used to convert the vowel allophone data into synthetic speech. The number of code books used to compress the vowel allophone parameters will vary depending on the nature of parameter representation being used. Nevertheless, the system architecture shown in FIG. 11 can be applied to all of these embodiments because the basic methodology for selecting vowel allophones and retrieving the data representing a selected vowel allophone is unchanged.

What is claimed is:

1. In a text-to-speech conversion system having means for converting a specified text string into a corresponding string of consonant and vowel phonemes, each said phoneme being selected from a predefined set of phonemes including a multiplicity of consonant phonemes and a multiplicity of vowel phonemes; parameter generating means for generating speech parameters corresponding to said string of phonemes; and speech synthesizing means for generating a speech waveform corresponding to the speech parameters generated by said parameter generating means; the improvement comprising:

vowel allophone storage means for storing a multiplicity of vowel allophones, each said stored vowel allophone comprising a set of speech parameters; said vowel allophones including allophones for a multiplicity of vowel phonemes;

context table means for assigning one of said vowel allophones to every vowel phoneme context LVR, where V represents any vowel phoneme selected from said multiplicity of vowel phonemes, L represents any consonant phoneme immediately preceding said vowel phoneme V selected from said predefined set of phonemes, and R represents any consonant phoneme immediately following said vowel phoneme V selected from said predefined set of phonemes; said context table means including a distinct entry for every phoneme context LVR denoting which of said vowel allophones is assigned to each said phoneme context LVR; and vowel allophone generating means, coupled to said vowel allophone storage means, for providing speech parameters representative of a specified vowel phoneme to said parameter generating means, including allophone selection means coupled to said context table means for selecting one of said multiplicity of vowel allophones for each of at least a subset of said vowel phonemes in said string of phonemes, said allophone selection means including context indexing means for determining the phonemes in said string which immediately precede and follow said vowel phonemes in said string of phonemes, said allophone selection means including context indexing means for determining the phonemes in said string which immediately precede and follow said vowel phoneme in said string of phonemes, and table lookup means for assigning to said vowel phoneme the vowel allophone denoted in said context table means for said vowel phoneme in the context of said preceding and following phonemes;

whereby the speech parameters used to synthesize vowel phonemes represent vowel allophones corresponding to the contexts of said vowel phonemes.

2. The text-to-speech conversion system set forth in claim 1, said vowel allophone storage means including:

speech storage means for storing the speech parameters for each said vowel allophone; said speech storage means including code book means for storing a multiplicity of sets of speech parameters; and allophone means for denoting, for each said vowel allophone, one of said multiplicity of sets of speech parameters in said code book means.

3. The text-to-speech conversion system set forth in claim 1, said context indexing means including vowel substitution means for use when a vowel phoneme $V_1$ in said string of phonemes is immediately preceded or followed by a vowel phonemes, said vowel substitution means including means for selecting an entry in said context table means to use for assigning one of said vowel allophones to said vowel phoneme $V_1$.

4. The text-to-speech conversion system as set forth in claim 1, said context indexing means including vowel substitution means for use when a vowel phoneme $V_1$ in said string of phonemes occurs in a phoneme context $CV_1V_2$ or $V_2V_1C$, where C is a consonant phoneme and $V_2$ is a vowel phoneme neighboring said vowel phoneme $V_1$, said vowel substitution means including means for selecting one of said phoneme contexts LVR which is phonetically equivalent to said phoneme context $CV_1V_2$or $V_2V_1C$; said table lookup means including means for assigning to said vowel phoneme $V_1$ the vowel allophone denoted in said context table means for said phonetically equivalent phoneme context LVR.

5. In a text-to-speech conversion system having means for converting a specified text string into a corresponding string of consonant and vowel phonemes, each said phoneme being selected from a predefined set of phonemes including a multiplicity of consonant phonemes and a multiplicity of vowel phonemes; parameter generating means for generating formant parameters corresponding to said string of phonemes; and formant synthesizing means for generating a speech waveform corresponding to the formant parameters generated by said parameter generating means; the improvement comprising:

vowel allophone storage means for storing a multiplicity of vowel allophones, each said stored vowel allophone comprising a set of formant parameters; said vowel allophones including allophones for a multiplicity of vowel phonemes; said vowel allophone storage means including context indexing means for associating each said vowel allophone with one or more pairs of phonemes preceding and following the corresponding vowel phoneme in a phoneme string;

context table means for assigning one of said vowel allophones to every vowel phoneme context LVR, where V represents any vowel phoneme selected from at least a subset of said multiplicity of vowel phonemes, L represents any consonant phoneme immediately preceding said vowel phoneme V selected from said predefined set of phonemes, and R represents any consonant phoneme immediately following said vowel phoneme V selected from said predefined set of phonemes; said context table means including a distinct entry for every phoneme context LVR denoting which of said vowel allophones is assigned to each said phoneme context LVR; and vowel allophone generating means, coupled to said vowel allophone storage means, for providing formant parameters representative of a specified vowel phoneme to said parameter generating means, including allophone selection means coupled to said context table means for selecting one of said multiplicity of vowel allophones for each of at least a subset of said vowel phonemes in said string of phonemes, said allophone selection means including means for determining the phonemes in said string which immediately precede and follow said vowel phoneme in said string of phonemes, and means for assigning to said vowel phoneme the vowel allophone detected in said context table means for said vowel phoneme in the context of said preceding and following phonemes;

whereby the formant parameters used to synthesize vowel phonemes represent vowel allophones corresponding to the contexts of said vowel phonemes.

6. The text-to-speech conversion system set forth in claim 5, said vowel allophone storage means including:

formant storage means for storing parameters for a multiplicity of formants for each said vowel allophone; said formant storage means including code book means for storing a multiplicity of sets of formant parameters; and allophone means for denoting, for each said vowel allophone, one of said multiplicity of sets of formant parameters in said code book means.

7. The text-to-speech conversion system set for in claim 6, wherein the number of sets of formant parameters stored in said code book means is much less than the number of vowel allophones stored by said vowel allophone storage means; the sets of formant parameters stored in said code book means being selected from sets of formant parameters representing substantially all of said vowel allophones using a minimax distortion vector quantization process.

8. The text-to-speech conversion system set forth in claim 5, each vowel allophone in said vowel allophone storage means including a set of back and forward boundary parameters representative of speech formants at the boundaries of the allophone, and a set of intermediate parameters representative of speech formants between the back and forward boundaries of the allophone;

said vowel allophone storage means including:

formant storage means for storing parameters for a multiplicity of formants for each said vowel allophone; said formant storage means including code book means for storing a multiplicity of sets of intermediate formant parameters; and allophone means for denoting, for each said vowel allophone, boundary values for said vowel allophone and one of said multiplicity of sets of intermediate formant parameters in said code book means.

9. The text-to-speech conversion system set forth in claim 8, each said set of intermediate formant parameters in said code book means representing the intermediate trajectory of one formant for a vowel allophone;

said allophone means including means for denoting at least three of said sets of intermediate formant parameters;

whereby said vowel allophones comprise the formant parameters for at least three formants.

10. The text-to-speech conversion system set forth in claim 5, said vowel allophone storage means including means for storing vowel allophones as pronounced by a selected individual so that said text-to-speech conversion system produces synthetic speech which mimics said selected individual speaking an unlimited vocabulary.

11. The text-to-speech conversion system set forth in claim 5, said vowel allophone storage means including means for storing vowel allophones as pronounced by an individual speaking a selected dialect so that said text-to-speech conversion system produces synthetic speech which mimics said selected dialect.

12. The text-to-speech conversion system set forth in claim 5, said vowel allophone storage means including means for storing vowel allophones as pronounced by a specified cartoon character so that said text-to-speech conversion system produces synthetic speech which mimics said selected cartoon character.

13. The text-to-speech conversion system set forth in claim 5, said vowel allophone storage means including means for storing vowel allophones as pronounced by a plurality of selected individuals so that said text-to-speech conversion system produces synthetic speech which mimics a plurality of selected individuals.

14. In a method of converting text strings into synthetic speech, the steps comprising:

defining a set of phonemes, including a multiplicity of consonant phonemes and a multiplicity of vowel phonemes;

storing a multiplicity of predefined vowel allophones, each vowel allophone being represented by a set of speech parameters;

denoting in a data structure an assigned one of said vowel allophones for every phoneme context LVR, where V represents any vowel phoneme selected from at least a subset of said multiplicity of vowel phonemes, L represents any consonant phoneme immediately preceding said vowel phoneme V selected from said predefined set of phonemes, and R represents any consonant phoneme immediately following said vowel phoneme V selected from said predefined set of phonemes; said data structure containing a distinct allophone assignment entry for each said phoneme context LVR;

converting a specified text string into a corresponding string of phonemes, said string of phonemes including consonant and vowel phonemes, each said phoneme being selected from said defined set of phonemes; and for each vowel phoneme in at least a subset of said vowel phonemes in said string of phonemes, determining the phonemes in said string which immediately precede and follow said vowel phoneme in said string of phonemes, and then assigning said vowel phoneme the vowel allophone denoted in said data structure for said vowel phoneme in the context of said preceding and following phonemes.

15. The method of converting text strings into synthetic speech as set forth in claim 14, said storing step including the step of providing code book means for storing a multiplicity of sets of speech parameters, and allophone means for denoting, for each said vowel allophone, one of said multiplicity of sets of speech parameters in said code book means.

16. The method of converting text strings into synthetic speech as set forth in claim 15, wherein the number of sets of speech parameters stored in said code book means is much less than said predefined multiplicity of vowel allophones; the sets of speech parameters stored in said code book means being selected from sets of speech parameters representing substantially all of said vowel allophones using a minimax distortion vector quantization process.

17. The method of converting text strings into synthetic speech as set forth in claim 14, said storing step storing vowel allophones as pronounced by a selected individual so that said method produces synthetic speech which mimics said selected individual speaking.

18. In a method of converting text strings into synthetic speech, the steps comprising:

storing a multiplicity of predefined vowel allophones, each vowel allophone being represented by a set of formant parameters;

defining a set of phonemes, including a multiplicity of consonant phonemes and a multiplicity of vowel phonemes;

storing a multiplicity of predefined vowel allophones, each vowel allophone being represented by a set of formant parameters;

denoting in a data structure an assigned one of said vowel allophones for every phoneme context LVR, where V represents any vowel phoneme selected from at least a subset of said multiplicity of vowel phonemes, L represents any consonant phoneme immediately preceding said vowel phoneme V selected from said predefined set of phonemes, and R represents any consonant phoneme immediately following said vowel phoneme V selected from said predefined set of phonemes; said data structure containing a distinct allophone assignment entry for each said phoneme context LVR; and converting a specified text string into a corresponding string of phonemes, said string of phonemes including consonant and vowel phonemes, each said phoneme being selected from said defined set of phonemes;

for each vowel phoneme in at least a subset of said vowel phonemes in said string of phonemes, determining the phonemes in said string which immediately precede and follow said vowel phoneme in said string of phonemes, and then assigning said vowel phoneme the vowel allophone denoted in said data structure for said vowel phoneme in the context of said preceding and following phonemes.

19. The method of converting text strings into synthetic speech as set forth in claim 18, said storing step including the step of providing code book means for storing a multiplicity of sets of formant parameters, and allophone means for denoting, for each said vowel allophone, one of said multiplicity of sets of formant parameters in said code book means.

20. The method of converting text strings into synthetic speech as set forth in claim 19, wherein the number of sets of formant parameters stored in said code book means is much less than said predefined multiplicity of vowel allophones; the sets of formant parameters stored in said code book means being selected from sets of formant parameters representing substantially all of said vowel allophones using a minimax distortion vector quantization process.

21. The method of converting text strings into synthetic speech as set forth in claim 18, said storing step storing vowel allophones as pronounced by a selected individual so that said method produces synthetic speech which mimics said selected individual speaking.

22. In a method of converting text strings into synthetic speech, the steps comprising:

defining a set of phonemes, including a multiplicity of consonant phonemes and a multiplicity of vowel phonemes;

storing a multiplicity of predefined vowel allophones, each vowel allophone being represented by a set of speech parameters;

converting a specified text string into a corresponding string of phonemes, said string of phonemes including consonant and vowel phonemes, each said phoneme being selected from said defined set of phonemes; and for each of at least a subset of said vowel phonemes in said string of phonemes, computing a phoneme context value for said vowel phoneme as a function of a the phonemes in said string of phonemes which precede and follow said vowel phoneme, and then assigning to said vowel phoneme a selected one of said predefined vowel allophones corresponding to said computed phoneme context value; and converting said string of phonemes, including said assigned vowel allophones, into speech parameters and then generating an audio waveform corresponding to said speech parameters.

23. A text-to-speech synthesis system, comprising:

vowel allophone storage means storing a multiplicity of predefined vowel allophones, each vowel allophone being represented by a set of speech parameters;

text conversion means for converting a specified text string into a corresponding string of consonant and vowel phonemes, each said phoneme being selected from a predefined set of phonemes including a multiplicity of consonant phonemes and a multiplicity of vowel phonemes;

vowel phoneme to allophone conversion means, couple to said text conversion means and said vowel allophone storage means, for computing a phoneme context value for each of at least a subset of said vowel phonemes in said string of phonemes, said phoneme context value comprising a function of the phonemes in said string of phonemes which precede and follow said vowel phoneme, and for then assigning to said vowel phoneme a selected one of said predefined vowel allophones corresponding to said computed phoneme context value;

parameter generating means for generating speech parameters corresponding to said string of phonemes, including said speech parameters for said assigned vowel allophones; and speech synthesizing means for generating a speech waveform corresponding to the speech parameters generated by said parameter generating means.

* * * * *